US007033154B2

(12) United States Patent
Allen et al.

(10) Patent No.: US 7,033,154 B2
(45) **Date of Patent: *Apr. 25, 2006**

(54) LAMELLAR EXTRUSION DIE APPARATUS AND METHOD

(75) Inventors: Martin A. Allen, Dawsonville, GA (US); William Todd Simms, Cumming, GA (US); Matthew Duane Thompson, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 280 days.

This patent is subject to a terminal disclaimer.

(21) Appl. No.: 10/650,644

(22) Filed: Aug. 28, 2003

(65) Prior Publication Data

US 2005/0046066 A1 Mar. 3, 2005

(51) Int. Cl.
*D01D 5/084* (2006.01)

(52) U.S. Cl. ..... 425/72.2; 425/131.5; 425/378.2; 425/192 S

(58) Field of Classification Search ..... 425/72.2, 425/131.5, 378.2, DIG. 246, 192 S; 264/211.17, 264/172.11, 172.17; 156/433, 436, 157, 156/158, 166, 167, 176
See application file for complete search history.

(56) References Cited

U.S. PATENT DOCUMENTS 3,501,805 A 3/1970 Douglas, Jr. et al. ..... 18/8
3,613,170 A * 10/1971 Soda et al. ..... 425/131.5
3,807,917 A 4/1974 Shimoda et al. ..... 425/131
3,981,650 A 9/1976 Page ..... 425/72.2
4,406,850 A 9/1983 Hills ..... 264/171
4,586,690 A * 5/1986 Hartel et al. ..... 249/78
4,818,463 A 4/1989 Buehning ..... 425/72.2
5,017,116 A 5/1991 Carter et al. ..... 425/131.5

(Continued)

FOREIGN PATENT DOCUMENTS

EP 0893517 1/1999

OTHER PUBLICATIONS

International Fiber Journal, *Special Report on Biocomponent Fibers Acquisitions Shake Up Fiber Industry Show Reports: Fiber Producer Exhibition, IDEA 98*, Jun. 1998.

*Primary Examiner*—Joseph S. Del Sole
(74) *Attorney, Agent, or Firm*—Wood, Herron & Evans, L.L.P.

(57) ABSTRACT

A lamellar die apparatus for extruding a heated liquid into single or multiple component filaments. The apparatus includes a plurality of plates each having opposite side faces. At least two of the side faces confront each other and have a liquid passage positioned therebetween for transferring the heated liquid. At least two of the side faces confront each other and have a heating element passage therebetween. A heating element is positioned within the heating element passage for heating at least two of the plates. An extrusion die is coupled with the plurality of plates and communicates with the liquid passage for discharging the heated liquid as multiple filaments.

13 Claims, 4 Drawing Sheets

U.S. PATENT DOCUMENTS 5,145,689 A 9/1992 Allen et al. ..... 425/72.2
5,162,074 A 11/1992 Hills ..... 156/644
5,344,297 A 9/1994 Hills ..... 425/131.5
5,466,410 A 11/1995 Hills ..... 264/172.11
5,511,960 A 4/1996 Terakawa et al. ..... 425/131.5
5,551,588 A 9/1996 Hills ..... 216/56
5,562,930 A 10/1996 Hills ..... 425/198
5,580,581 A 12/1996 Buehning ..... 425/72.2
5,601,851 A 2/1997 Terakawa ..... 425/72.2
5,679,379 A * 10/1997 Fabbricante et al. ..... 425/7
6,120,276 A 9/2000 Balk ..... 425/72.2
6,478,563 B1 11/2002 Allen ..... 425/72.2
6,491,507 B1 12/2002 Allen ..... 425/7
2005/0046066 A1 * 3/2005 Allen et al. ..... 264/103

* cited by examiner

LAMELLAR EXTRUSION DIE APPARATUS AND METHOD

FIELD OF THE INVENTION

The present invention generally relates to apparatus and methods for extruding thermoplastic filaments and, more particularly, apparatus for spunbonding multi-component or single component filaments.

BACKGROUND OF THE INVENTION

Melt spinning techniques, such as spunbonding or meltblowing techniques, for extruding fine diameter filaments find many different applications in various industries including, for example, in nonwoven material manufacturing. This technology generally involves extruding a thermoplastic material from multiple rows of discharge outlets extending along the lower surface of an elongate spinneret. Spunbonded and/or meltblown materials are used in such products as diapers, surgical gowns, carpet backings, filters and many other consumer and industrial products. The machines for meltspinning such materials can be very large and include numerous filament discharge outlets.

For certain applications, it is desirable to utilize two or more types of thermoplastic liquid materials to form individual cross-sectional portions of each filament. Often, these multi-component filaments comprise two components and, therefore, are referred to as bicomponent filaments. For example, when manufacturing nonwoven materials for use in the garment industry, it may be desirable to produce bicomponent filaments having a sheath-core construction. The outer sheath may be formed from a softer material which is comfortable to the skin of an individual and the inner core may be formed from a stronger, but perhaps less comfortable material having greater tensile strength to provide durability to the garment. Another important consideration involves cost of the material. For example, a core of inexpensive material may be combined with a sheath of more expensive material. For example, the core may be formed from polypropylene or nylon and the sheath may be formed from a polyester or co-polyester. Many other multi-component fiber configurations exist, including side-by-side, tipped, and microdenier configurations, each having its own special applications. Various material properties can be controlled using one or more of the component liquids. These include, as examples, thermal, chemical, electrical, optical, fragrance, and anti-microbial properties. Likewise, many types of die tips exist for combining the multiple liquid components just prior to discharge or extrusion to produce filaments of the desired cross-sectional configuration.

One problem associated with multi-component extrusion apparatus involves the cost and complexity of the manifolds used to transmit liquid(s) to the spinneret or extrusion die. Typical manifolds are machined with many different passages to ensure that the proper flow of each component liquid reaches the die under the proper pressure and temperature conditions. These manifolds are therefore relatively complex and expensive components of the melt spinning apparatus.

For these reasons, it would be desirable to provide a an extruding apparatus having a manifold system which may be easily manufactured while still achieving the goal of effectively transmitting the heated liquid or liquids to the die tip.

SUMMARY OF THE INVENTION

The invention generally provides a lamellar die apparatus for extruding a heated liquid into filaments preferably by spunbonding techniques. The apparatus is constructed with a plurality of plates each having opposite side faces. At least two of the side faces confront each other and have a liquid passage positioned therebetween for transferring the heated liquid. At least two of the side faces confront each other and have a heating element passage therebetween. A heating element is positioned within the heating element passage for heating the liquid in the liquid passage. An extrusion die is coupled with the plurality of plates and communicates with the liquid passage for discharging the heated liquid as multiple filaments.

The liquid passage is preferably formed by respective first and second recesses on adjacent plates that abut one another. Likewise, the heating element passage is formed by respective third and fourth recesses on adjacent plates that abut one another. Recesses from different ones of these pairs of recesses may, for example, be located on opposite sides of the same plate. In the preferred embodiment, multiple heating element passages are positioned between two of the plates and multiple heating elements are respectively contained in the heating element passages.

The liquid passage includes an inlet portion and an outlet portion with the outlet portion being wider than the inlet portion. The outlet portion of the liquid passage forms an elongate liquid outlet slot. The extrusion die includes an elongate liquid inlet slot aligned in communication with the elongate liquid outlet slot to facilitate liquid flow to the extrusion outlets.

The invention further contemplates methods of extruding liquid filaments, such as single or multiple component thermoplastic polymeric filaments, in general accordance with the use of the apparatus described above.

Various advantages, objectives, and features of the invention will become more readily apparent to those of ordinary skill in the art upon review of the following detailed description of the preferred embodiments, taken in conjunction with the accompanying drawings.

DETAILED DESCRIPTION

Figure 1:
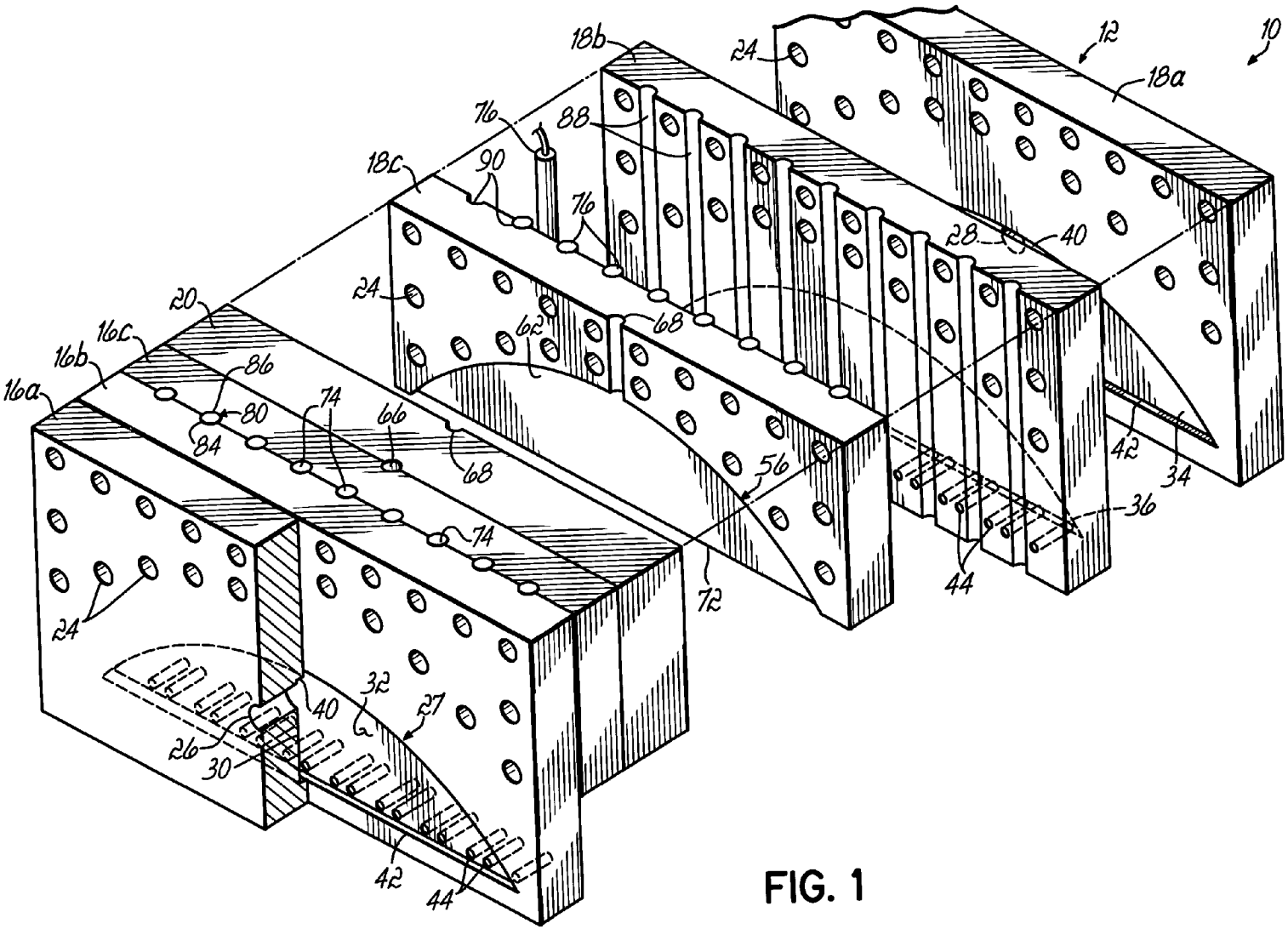
FIG. 1 is an exploded perspective view of a multi-component spunbonding apparatus constructed in accordance with a preferred embodiment of the invention.
Figure 2:
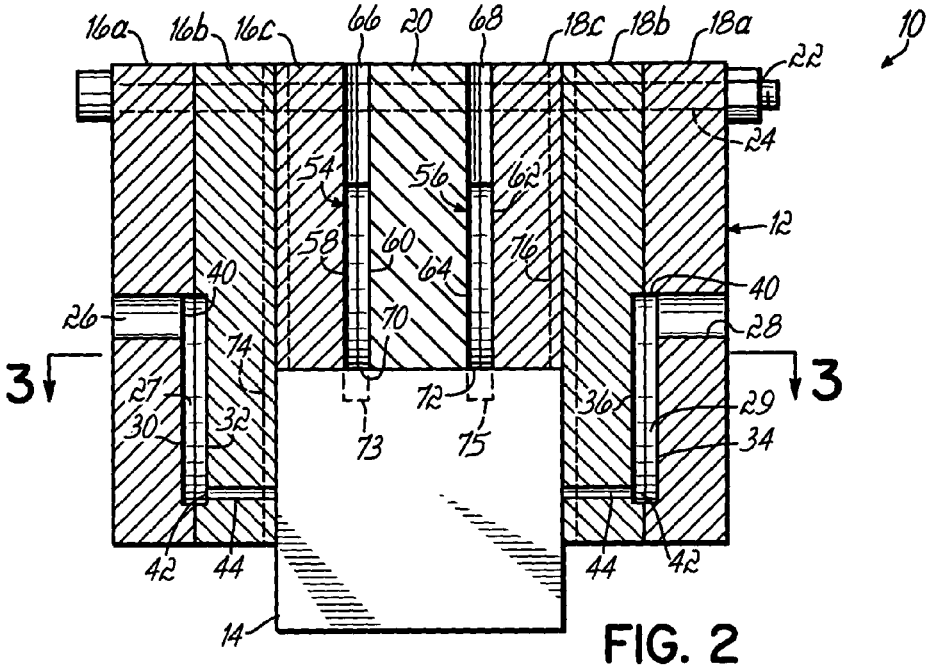
FIG. 2 is a cross sectional view taken along line 2—2 of FIG. 3.
Figure 3:
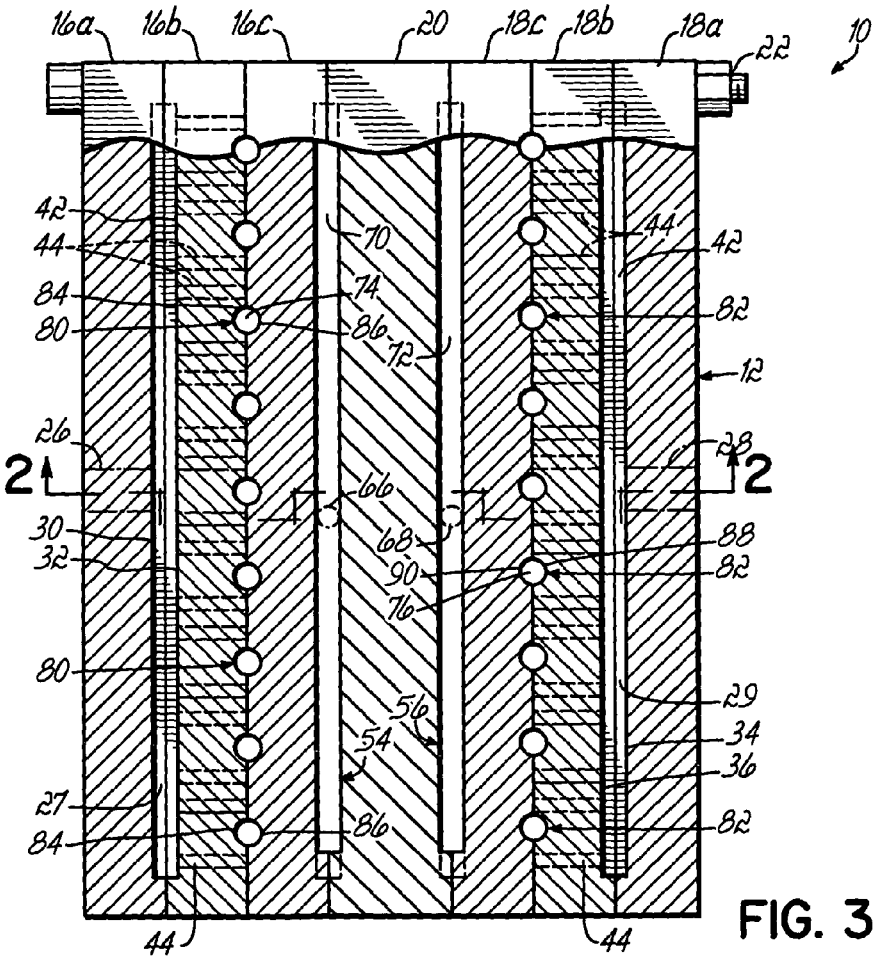
FIG. 3 is a fragmented top view of the assembled apparatus of FIG. 1 taken generally along line 3—3 of FIG. 2.

FIGS. 1–3 illustrate a die apparatus 10 constructed in accordance with a first embodiment. Apparatus 10 is comprised of a manifold structure 12 coupled for fluid communication with an extrusion die 14. Manifold structure 12 is a lamellar construction or plate assembly comprised of multiple plates 16*a–c*, 18*a–c* and 20. These plates are securely fastened together in side-by-side relation using appropriate fasteners 22 (only one shown in FIGS. 2 and 3) extending through holes 24 in each of the plates. As best shown in FIG. 2, respective outside pairs of plates 16*a*, 16*b* and 18*a*, 18*b* form optional air manifold sections and include respective quench air input ports 26, 28. Positive pressure quench air assists in quickly cooling the discharged filaments. Optionally, vacuum may be drawn through ports 26, 28 for purposes of removing monomer gases at the filament discharge area. In each case, it will be understood that the appropriate openings (not shown) will be provided in or adjacent die 14 to allow the discharge of quench air or intake of monomer gases. Plates 16*a*, 16*b* and 18*a*, 18*b* respectively abut each other and contain air passages 27, 29 therebetween. Air passages 27, 29 are respectively formed by pairs of recesses 30, 32 and 34, 36 that align with each other in abutting faces of the plates 16*a*, 16*b* and 18*a*, 18*b*.

As shown best in FIG. 1, these recesses 30, 32 and 34, 36 take the form of so-called coat hangar recesses which become wider in dimension from the inlet portion 40 located proximate input ports 26, 28 to an outlet portion 42 located proximate respective distribution passages 44. Distribution passages 44 extend respectively through plates 16*b* and 18*b* and lead to extrusion die 14. Plates 16*c* and 18*c* respectively abut central plate 20 as shown.

Respective liquid passages 54, 56 are formed between plates 16*c*, 20 and 18*c*, 20 and, again, are formed by respective pairs of coat hangar recesses 58, 60 and 62, 64 that align with each other in abutting surfaces of these plates 16*c*, 20 and 18*c*, 20. As shown in FIG. 1A, these recesses 58, 60 and 62, 64 are also formed with a coat hangar configuration between inlet portions adjacent respective liquid input ports 66, 68 and outlet portions which form elongate liquid outlet slots 70, 72 for abutting the top surface of the extrusion die 14 and aligning with coextensive liquid inlet slots 73, 75. In this embodiment, the two liquid input ports 66, 68 and coat hangar passages 54, 56 are provided for producing bicomponent filaments from extrusion die 14. Extrusion die 14 may be any suitable extrusion die having, for example, a laminated plate construction with appropriate porting and passages to combine and extrude filaments from the outlet orifices extending along the underside of the extrusion die 14 and to attenuate or otherwise affect those filaments with process air. Representative dies are, for example, disclosed in U.S. Pat. Nos. 5,562,930; 5,551,588; and 5,344,297, however, such dies would require modification with suitable passages to transfer and discharge quench air received from distribution passages 44.

Also in accordance with the invention, heating elements 74, 76 are respectively contained in passages 80, 82 between plates 16*b*, 16*c* and 18*b*, 18*c*. Each passage is again preferably formed by respective pairs of aligned and abutting recesses 84, 86 and 88, 90 in plates 16*b*, 16*c* and 18*b*, 18*c*. These heating elements 74, 76, which are preferably electrically operated heating elements, may be advantageously situated between the respective air and liquid passages 27, 54 and 29, 56 so as to heat both the liquid and the air traveling to extrusion die 14. Sufficient heat may also be supplied to heat the extrusion die 14 itself to the appropriate operating temperature.

Figure 4:
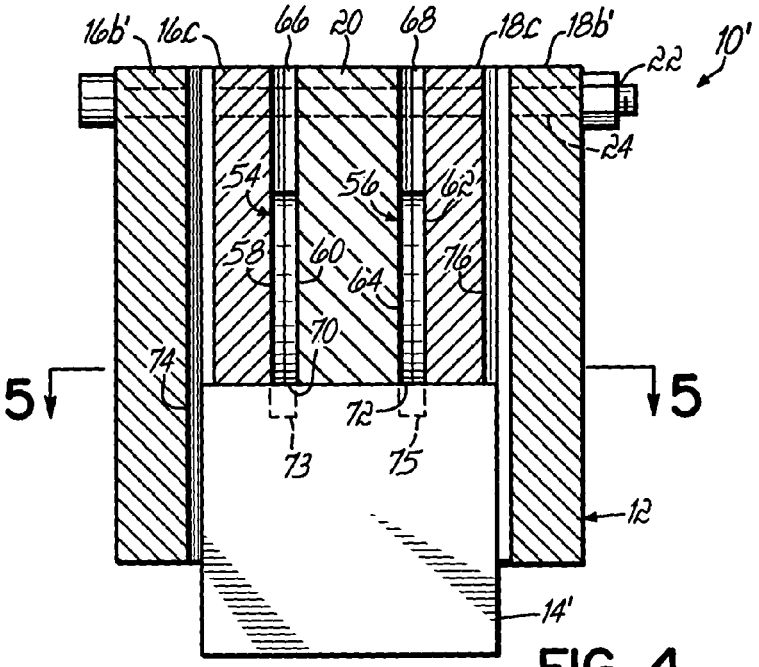
FIG. 4 is a cross sectional view similar to FIG. 2, but illustrating an alternative embodiment of the apparatus and taken along line 4—4 of FIG. 5.
Figure 5:
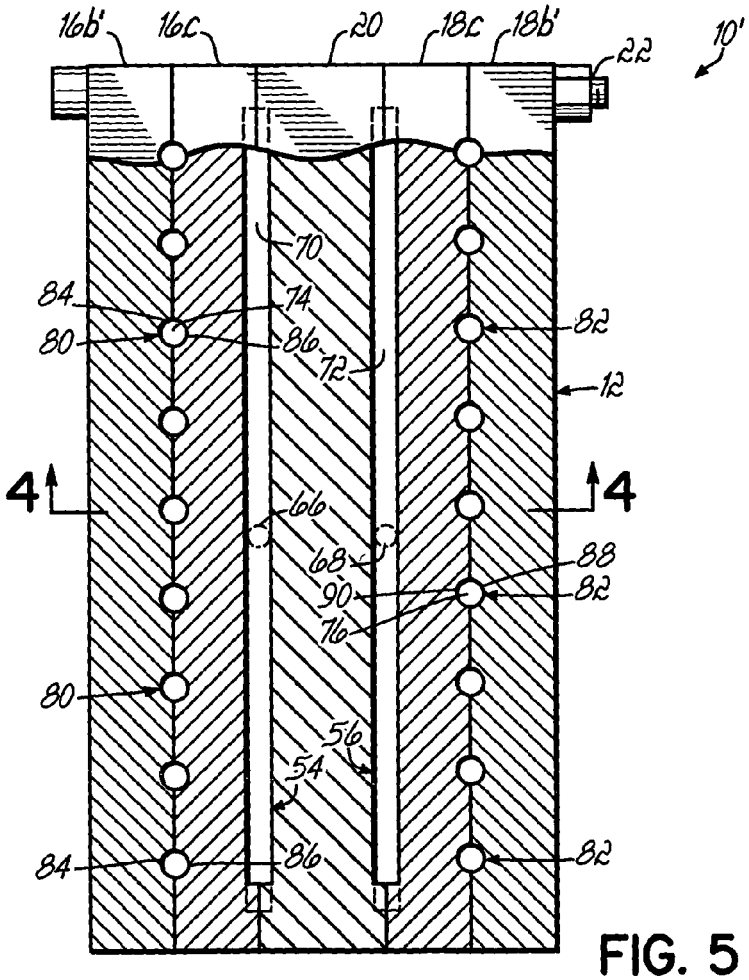
FIG. 5 is a cross sectional view taken along line 5—5 of FIG. 4.

FIGS. 4 and 5 illustrate another apparatus 10' constructed in accordance with the invention. In this embodiment, apparatus 10' again comprises a multiple plate assembly or manifold structure 12' coupled with an extrusion die 14'. Manifold structure 12' and die 14' are similar to the first embodiment except that a five plate construction is used instead of a seven plate construction thereby eliminating the quench air. In this embodiment, plates 16*a*, 18*a* have been eliminated from the outside of the manifold structure 12' to eliminate the quenching air to the extrusion die 14'. This quenching air can instead be discharged at the filaments by other means such as conventional components located below die 14'. Other elements indicated with like reference numerals to the first embodiment but have prime mark (') designations are only slightly modified as shown. Elements having like numerals to the first embodiment are identical elements. In both cases, no further description is necessary to an understanding of the invention.

Figure 6:
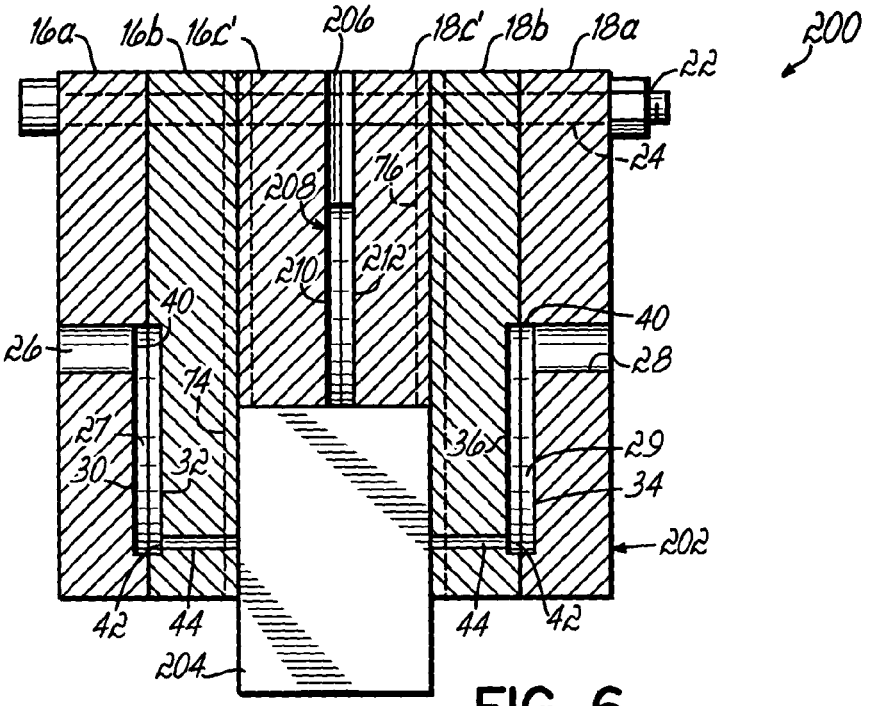
FIG. 6 is a cross sectional view similar to FIG. 2, but illustrating another alternative embodiment of the apparatus.

FIG. 6 illustrates another alternative die apparatus 200 having a laminated plate construction. This apparatus 200 is similar to that described above with respect to the first embodiment (FIGS. 1–3), but is configured to discharge single component filaments or monofilaments rather than a bicomponent filament. Thus, the central plate 20 used in the first embodiment has been eliminated thereby resulting in a six plate construction rather than a seven plate construction for manifold structure 202. As with the previous embodiments, an extrusion die 204 is coupled to manifold structure 202 for discharging one or more filaments and, optionally, discharging quenching air. A single liquid input port 206 and coat hanger passage 208 receive the liquid, such as a thermoplastic polymer. Coat hanger passage 208 is formed by aligned recesses 210, 212 in abutting faces of plates 16*c'* and 18*c'*. Plates 16*c'* and 18*c'* are designated with prime marks (') to denote that they are slightly modified, as illustrated, from plates 16*c*, 18*c*. All other aspects of apparatus 200 are as described above with respect to the first embodiment and, therefore, identical reference numerals have been used and no further description is necessary.

Figure 7:
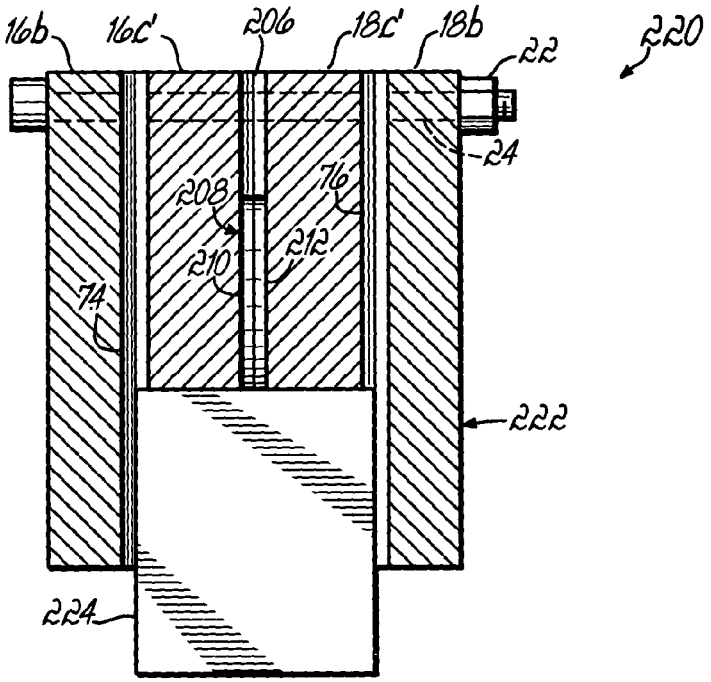
FIG. 7 is a cross sectional view similar to FIG. 4, but illustrating another alternative embodiment of the apparatus.

FIG. 7 illustrates another alternative apparatus 220 similar to that described above with respect to FIGS. 4 and 5 but, like the embodiment of FIG. 6, apparatus 220 is configured to discharge single component filaments or monofilaments rather than bicomponent filaments. Again, the central plate 20 of the embodiment illustrated in FIGS. 4 and 5 has been eliminated and a four plate manifold structure 222 results. Manifold structure 222 is configured to deliver a single type of liquid, such as a thermoplastic polymer, to an extrusion die 224. A single liquid input port 206 and a coat hanger passage 208 is formed between abutting plates 16*c'*, 18*c'* to communicate with an appropriate elongate inlet slot (not shown) in the top of the extrusion die 224. Plates 16*c'* and 18*c'* are identical to those shown in FIG. 6. All other aspects of the embodiment shown in FIG. 7 are described with respect to the first two embodiments described above and, therefore, identical reference numerals have been used and no further description is necessary.

While the present invention has been illustrated by a description of various preferred embodiments and while these embodiments has been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

The invention claimed is:

1. A lamellar die apparatus for extruding a heated liquid into filaments, comprising:

a plurality of plates each having opposite side faces, at least two of said side faces confronting each other and having a liquid passage positioned therebetween for transferring the heated liquid, and at least two of said side faces confronting each other and having a heating element passage therebetween, said heating element passage being formed by respective first and second aligned recesses on different ones of said plates which abut one another, a heating element positioned within said heating element passage for heating the liquid in said liquid passage, and an extrusion die coupled with said plurality of plates and communicating with said liquid passage for discharging the heated liquid as multiple filaments.

2. The apparatus of claim 1, wherein said liquid passage is formed by respective third and fourth recesses on different ones of said plates which abut one another, and said heating element passage is formed by respective fifth and sixth recesses on different ones of said plates which abut one another.

3. The apparatus of claim 1, further comprising a plurality of heating element passages positioned between two of said plates that abut one another and a plurality of heating elements respectively contained in said plurality of heating element passages, each of said heating element passages being formed by a recess formed in a side face of one of said two plates and an aligned recess formed in a side face of the other of said two plates.

4. The apparatus of claim 1, wherein said liquid passage includes an inlet portion and an outlet portion, said outlet portion being wider than said inlet portion.

5. The apparatus of claim 4, wherein said outlet portion of said liquid passage forms an elongate liquid outlet slot.

6. The apparatus of claim 5, wherein said extrusion die includes an elongate liquid inlet slot aligned in communication with said elongate liquid outlet slot.

7. A lamellar die apparatus for extruding at least two heated liquids into multi-component filaments, comprising:

a plurality of plates each having opposite side faces, at least two of said side faces confronting each other and having a first liquid passage positioned therebetween for transferring a first heated liquid, at least two of said side faces confronting each other and having a second liquid passage positioned therebetween for transferring a second heated liquid, and at least two of said side faces confronting each other and having a first heating element passage therebetween, said heating element passage being formed by respective first and second aligned recesses on different ones of said plates which abut one another, a heating element positioned within said first heating element passage for heating at least two of said plates, and an extrusion die coupled with said plurality of plates and communicating with said first and second liquid passages for discharging the first and second heated liquids as the multi-component filaments.

8. The apparatus of claim 7, wherein said first liquid passage is formed by respective third and fourth recesses on different ones of said plates which abut one another, said second liquid passage is formed by respective fifth and sixth recesses on different ones of said plates which abut one another, and said first heating element passage is formed by respective seventh and eighth recesses on different ones of said plates which abut one another.

9. The apparatus of claim 7, further comprising a plurality of heating element passages positioned between two of said plates that abut one another and a plurality of heating elements respectively contained in said plurality of heating element passages, each of said heating element passages being formed by a recess formed in a side face of one of said two plates and an aligned recess formed in a side face of the other of said two plates.

10. The apparatus of claim 7, further comprising a second heating element passage located on an opposite side of said first and second liquid passages from said first heating element passage.

11. The apparatus of claim 7, wherein said first and second liquid passages each include an inlet portion and an outlet portion, said outlet portion being wider than said inlet portion.

12. The apparatus of claim 11, wherein said outlet portions of said first and second liquid passages form respective elongate first and second liquid outlet slots.

13. The apparatus of claim 12, wherein said extrusion die includes first and second elongate liquid inlet slots respectively aligned in communication with said first and second elongate liquid outlet slots.

* * * * *